United States Patent [19]

Yamamoto et al.

[11] Patent Number: 4,563,215

[45] Date of Patent: Jan. 7, 1986

[54] TITANIUM NITRIDE BASE CERMETS WITH HIGH TOUGHNESS

[75] Inventors: Yoshihiro Yamamoto, Iwakura; Junichiro Suzuki, Gifu, both of Japan

[73] Assignee: NGK Spark Plug Co., Ltd., Nagoya, Japan

[21] Appl. No.: 459,938

[22] Filed: Jan. 21, 1983

[30] Foreign Application Priority Data

Jan. 25, 1982 [JP] Japan ..... 57-9792

[51] Int. Cl.[4] ..... B22F 3/12; C22C 29/00

[52] U.S. Cl. ..... 75/238; 75/239; 75/240; 75/241; 75/244; 419/13; 419/14

[58] Field of Search ..... 75/238, 239, 240, 241, 75/244; 419/13, 15

[56] References Cited

U.S. PATENT DOCUMENTS

| | | | |
|---|---|---|---|
| 4,065,301 | 12/1977 | Tanaka et al. | 75/238 |
| 4,330,333 | 5/1982 | Gibbs | 75/238 |
| 4,447,263 | 5/1984 | Sugizawa et al. | 75/244 |

FOREIGN PATENT DOCUMENTS

| | | |
|---|---|---|
| 54-30209 | 3/1979 | Japan . |
| 1499278 | 1/1978 | United Kingdom . |

OTHER PUBLICATIONS

Chemical Abstracts, vol. 96, No. 6, 1982, Abstract No. 39507, "Composite Cermet Sintered Body".

Chemical Abstracts, vol. 82, No. 10, 1975, Abstract No. 63201e, "Hard Titanium Nitride Base Sinter", Abstract No. 63203g, "Hard Titanium Carbide Base Sinter".

*Primary Examiner*—Edward A. Miller

*Assistant Examiner*—Anne Brookes

*Attorney, Agent, or Firm*—Wegner & Bretschneider

[57] ABSTRACT

A titanium nitride base cermet with high toughness comprises, by weight, 42 to 95% of TiN, 2 to 20% of one or more of Mo, W and the carbides thereof, 2.85 to 30% of an Ni, Co or a mixture thereof, and 0.15 to 8.0% of $Al_4C_3$, with the balance being inevitable impurities, wherein half or less of TiN may be replaced with one or more of the carbides and/or carbonitrides of metals from the Groups IVa and Va of the periodic table, with the proviso that the amount of TiN is no less than 30% in the cermet.

15 Claims, No Drawings

TITANIUM NITRIDE BASE CERMETS WITH HIGH TOUGHNESS

BACKGROUND

The present invention relates to a material for cutting tools, which has high toughness and strength, and excels in the resistance to both abrasion and plastic deformation.

Japanese Patent Kokai Publication No. 54-30209 discloses a cutting tool material obtained by adding AlN to a TiN-containing TiC base cermet. Although that cermet is known to have been improved with respect to cutting properties and mechanical properties, it is still not sufficient in strength since the base material per se still has a low strength, in spite of the fact that the AlN addition makes some contribution to increase in strength. At present, therefore, it is hardly used for heavy cutting, high impact milling or intermittent cutting. On the other hand, TiN base cermets excel in rupture toughness and stand up to thermal shock but, since the TiN per se shows unsatisfactory wetting compatibility with a bonding metal of iron group metals, they have such an increased number of pores that they are deficient in the strength and in the resistance to both abrasion and plastic deformation.

SUMMARY OF THE DISCLOSURE

The present invention has been accomplished with a view to reducing or eliminating the defects of the prior art as mentioned above, and has for its object to provide a novel titanium nitride base cermet with high toughness.

The present invention provides a titanium nitride base cermet with high toughness consisting essentially of, by weight, 42 to 95% TiN, 2 to 20% one or more of Mo, W and carbides thereof, 2.85 to 30% iron goup metal and 0.15 to 8.0% $Al_4C_3$, with the balance being inevitable impurities.

The present invention further provides a variation of the aforesaid cermet characterized in that half or less of TiN is replaced with one or more of the carbides and/or carbonitrides of metals of Groups IVa and Va of the periodic table "(Groups IVB and VB according to U.S. practice)", provided that the amount of TiN is no less than 30% by weight.

The cermets according to the present invention have been found to have significantly improved cutting properties over the prior art cermets.

According to the present invention, the addition of $Al_4C_3$ to the TiN base cermets noticeably improves the wetting compatibility of TiN with bonding metal of iron group metals, so that the resulting sintered bodies have a reduced or limited number of pores. This results in the improvements in mechanical strength and cutting properties which are suitable for heavy cutting, high impact milling, intermittent cutting or profiling cutting wherein the magnitude and direction of stresses vary during cutting, which have been difficult to perform with the conventional cermet tools.

The iron group metal encompasses Ni and Co, preferably, a mixture thereof.

The metals of the Group IVa and Va of the periodic table (Groups IVB and VB according to U.S. practice) is defined according to the periodic table as presented in Elements of Physical Chemistry, 1960, D. Van Nostrand Co., Inc. (Maruzen Asian Edition) pp. 163 and encompass Ti, Zr, Hf, V, Nb and Ta. The carbides and/or carbonitrides of those metals at least encompass TiC, ZrC, HfC, VC, NbC, TaC, TiCN and the like, a mixture thereof being also employable.

PREFERRED EMBODIMENT OF THE DISCLOSURE

The cermets obtainable according to the preferred embodiments of the present invention provide an improved Rockwell hardness A scale (HRA) ranging from 91.3 to 92.4 or higher while the cutting tests exhibit prominent improvements in the cutting properties, i.e., the resistance against the wear and the edge failure owing to fracture.

In what follows, % will be given by weight, unless otherwise specified.

W, Mo and the carbides thereof are effective in improving the wetting compatibility or wettability of the hard phases with bonding metal, and are less effective in an amount below 2%. In an amount exceeding 20%, however, it is likely that the intermediate layer phase composed of a composite carbonitride formed around TiN grains becomes so brittle that the resulting alloy has a limited strength; in addition, the relative amount of TiN reduces with the result that no full advantageous properties of TiN or the carbides and/or carbonitrides of metals from the Groups IVa and Va of the periodic table can sufficiently be developed.

The iron group metals bond together the hard phases to contribute to the improvement in the strength of the cermets. However, there is a drop of the strength of the cermets in an amount below 2.85%, whereas the hardness and the wear resistance of the alloys deteriorate in an amount exceeding 30%.

$Al_4C_3$ makes significant improvements in the wettability of the hard phases relative to the bonding metal but, no desired effect is obtained if its content is below 0.15%, whereas there are deteriorations in the strength and the cutting properties if its content exceeds 8%.

TiN, which forms the hard phases defining part of the titanium nitride base cermets with the high toughness according to the present invention, produces no desired effect in an amount of no more than 30%, and reduces the amount of other bonding metal or a wettability-improving material with a drop of toughness as a consequence.

It is noted, however, that the replacement of half or less of TiN with the carbide and/or carbonitride of an element(s) from the Group IVa and Va of the periodic table (Group IVB and VB according to U.S. practice) does improve the wettability of the hard phases relative to the bonding metal, and enhance the wear resistance and the thermal resistance as well. However, if the amount of the substituent(s) used exceeds 50% of TiN, the amount of TiN relatively reduces so that no advantages is taken of TiN entailing a drop in the strength. For the similar reason, no desired effect is obtained even though the substituent(s) amount(s) to half or more of TiN, if the content of TiN is lower than 30% in the cermet.

The cermets according to the present invention permit inevitable impurities listed as follows:

$O_2 < 1.0\%$, $Fe < 1.5\%$, $Cr < 0.5\%$ and traces of Na, Ca, Si, S, Cu, Mg, P, B and the like.

Those impurities are likely to be incorporated from the starting materials as well as during the manufacturing procedures.

In the following, the present invention will further be elucidated with reference to the Examples which are disclosed for better understanding of the invention and not for limitation thereof. Any modifications may be taken without departing from the concept and the claimed scope of the present invention.

EXAMPLES (% denotes % by weight)

Commercially available starting powdery materials of sintered bodies for cutting tools, as shown in Table 1, were mixed with 1% paraffine as a forming agent, and adjusted to such a composition as shown in Table 2 followed by wet mixed with acetone as an organic solvent which was effected in a stainless steel ball mill with superhard balls. The resultant powdery mixture was then dried, compacted at a pressure of 2 t/cm$^2$, and sintered at a temperature of 1450°–1500° C. for one hour in a 10 Torr Ar atmosphere to obtain cutting tool tip which, in turn, were measured on their hardness and bending strength. The tip was then cut into pieces having a size of SNGN 120408 (ISO, 12.7×12.7×4.76 mm, nose R 0.8 mm), polished, and subjected to cutting tests under the conditions as specified in Table 3. For the purpose of comparison, reference runs were carried out with the compositions departing from the scope of the present invention under the identical conditions.

TABLE 1

| | particle size μ | C amount etc* wt % | grade** Wt % | impurities*** |
|---|---|---|---|---|
| TiN | 1.5 | N21.2 | 99.31 | 0.32 $O_2$, C |
| TiC | 1.2 | 19.7 | 99.70 | 0.29 $O_2$, $N_2$ |
| TiCN | 1.5 | TiC/TiN = 50/50 | 99.08 | 0.76 $O_2$, 0.16 Fe |
| WC | 2.0 | 6.15 | 99.31 | 0.5 $O_2$, 0.1 Mo, Fe, Cr |
| $Mo_2C$ | 3.0 | 5.9 | 99.91 | 0.07 Fe |
| TaC | 1.0 | 6.3 | 98.85 | 0.8 Nb, 0.22 Fe, 0.12 Ti |
| HfC | 1.5 | 6.2 | 98.62 | — |
| NbC | 2.0 | 11.3 | 98.26 | — |
| ZrC | 1.2 | 11.5 | 98.11 | 1.04 Hf, 0.5 $O_2$, $N_2$, Fe |
| VC | 2.0 | 18.9 | 98.35 | 0.4 Fe, 0.25 Al, 0.2 Cr, 0.16 Ti, 0.15 Ta |
| Mo | 0.7 | — | 99.36 | 0.58 $O_2$, Fe |
| W | 0.8 | — | 99.21 | — |
| Ni | 1.5 | — | 99.06 | 0.75 $O_2$, 0.1 Co, Fe, S |
| Co | 1.2 | — | 99.75 | 0.5 $O_2$, 0.14 Ni, C, Fe, Na, Cu |
| $Al_4C_3$ | 3.0 | — | 99.72 | 1.45 $O_2$, 0.65 $N_2$, 0.1 Fe |

N.B.
*N amount for TiN
**purity
***if not specified, amount is trace.

TABLE 2

| Sample Nos. | Composition TiN | WC | $Mo_2C$ | W Mo | TiC | TiCN | TaC | HfC ZrC | NbC VC | Ni | Co | $Al_4C_3$ | Bending Strength kg/mm$^2$ | Hardness HRA | Cutting Tests 1 | 2 |
|---|---|---|---|---|---|---|---|---|---|---|---|---|---|---|---|---|
| 1 | 70 | 9.5 | | Mo3 | | | | | | 11 | 5 | 1.5 | 180 | 91.3 | 0.182 | 14 |
| 2 | 69.8 | | 10 | W3.7 | | | | | | 5 | 11 | 0.5 | 175 | 91.5 | 0.165 | 12 |
| 3 | 43 | | 7.8 | | 30 | | | | | 9 | 9 | 1.2 | 183 | 91.8 | 0.175 | 15 |
| 4 | 54 | | 6 | | | | 20 | HfC 5.5 | | 4 | 10 | 0.5 | 170 | 91.9 | 0.163 | 13 |
| 5 | 62 | | 4.7 | | | | 10 | | NbC 7.5 | 5 | 10 | 0.8 | 185 | 91.7 | 0.159 | 17 |
| 6 | 45 | | 8.5 | | 19.7 | | 10 | | | 6 | 10 | 0.8 | 180 | 92.0 | 0.160 | 12 |
| 7 | 55 | 5 | | Mo 3.5 | | 19.7 | | | | 8 | 8 | 0.8 | 173 | 92.2 | 0.149 | 15 |
| 8 | 64 | | 7 | | 9.5 | | | ZrC 1 | | 11 | 6 | 1.5 | 190 | 91.7 | 0.170 | 18 |
| 9 | 40 | 5 | 7 | | 10 | | 20 | | VC3 | 5 | 9.5 | 0.5 | 185 | 92.0 | 0.193 | 13 |
| 10 | 35 | | 10 | W 2 | | 35 | | | | 8 | 9 | 1 | 175 | 92.1 | 0.165 | 10 |
| 11R | 54 | 20 | 10 | | | | | | | 5 | 10 | 1 | 155 | 91.0 | 0.251 | 5 |
| 12R | 60 | | 1 | | | 21 | | | | 8 | 9 | 1 | 140 | 90.2 | 0.305 | 2 |
| 13R | 25 | | 8 | | 45 | | 4 | | | 8 | 9 | 1 | 145 | 91.6 | 0.215 | 3 |
| 14R | 60 | | 5 | | 10 | | 9 | | | 6 | 10 | | 158 | 90.0 | 0.329 | 2 |
| 15R | 45 | | 8 | | | 30 | | | | 9 | 8 | | 152 | 90.5 | 0.311 | 1.5 |
| 16R | 59.9 | | 10 | | 10 | | 5 | | | 10 | 5 | 0.1 | 152 | 90.4 | 0.291 | 2.5 |
| 17 | 50 | | 10 | W5 | 5 | | | | | 18 | 5 | 7 | 240 | 88.0 | 0.302 | 43 |
| 18R | 48 | | 5 | w5 | 7 | | 10 | | | 10 | 5 | 10 | 113 | 89.2 | 0.413 | 0.2 |
| 19 | 91 | | 2 | w1.2 | | | 1 | | | 4 | | 0.8 | 166 | 92.4 | 0.148 | 8 |
| 20R | 97 | | 0.5 | | | | | | | 2.3 | | 0.2 | not sinterable | | | |
| 21 | 66 | | 3 | | | | 15 | | | 10 | 5 | 1.0 | 178 | 92.2 | 0.156 | 13 |
| 22 | 45.2 | | 10 | w7 | 20 | | 5 | | | 8 | 4 | 0.8 | 170 | 91.9 | 0.151 | 12 |
| 23R | 35 | | 8 | | 37.3 | | | ZrC3 | | 8 | 8 | 0.7 | 150 | 91.4 | 0.173 | 4 |

TABLE 2-continued

| Sample Nos. | Composition TiN | WC | $Mo_2C$ | W Mo | TiC | TiCN | TaC | HfC ZrC | NbC VC | Ni | Co | $Al_4C_3$ | Bending Strength $kg/mm^2$ | Hardness HRA | Cutting Tests 1 | 2 |
|---|---|---|---|---|---|---|---|---|---|---|---|---|---|---|---|---|
| 24 | 38 | | 4 | w3.2 | 35 | | | | VC5 | 10 | 4 | 0.8 | 170 | 91.8 | 0.166 | 12 |

Note for Table 2:
1. Suffixed "R" stands for reference runs.
2. Bending strength was measured by three points bending test using 8 × 4 × 20 mm test pieces according to JIS B 4104.
3. Composition is given by weight %.
4. Hardness is given in Rockwell A scale.
5. The condition for cutting tests 1 and 2 are given in Table 3.

TABLE 3

| | Conditions for Cutting Tests 1 | 2 |
|---|---|---|
| Cutting Manner | Continuous dry cutting of rod material | Dry milling |
| Work piece | JIS S45C | JIS SCM440 (100 × 100) |
| Cutting Speed | 250 m/min | 100 m/min |
| Feeding Rate | 0.3 mm/rev | 0.3 mm/rev |
| Depth of Cut | 1.0 mm | 1.5 mm |
| Cutting Time | 10 minutes | — |
| Shape of tip | SNGN 432 (honing 0.1 × 25°) | SNGN 432 (honing 0.1 × 25°) |
| Evaluation | Wear of clearance face after 10-minute cutting $V_B$ (mm) | Cutting cycles until tip fracture |

It is evident from Table 2 that the tips obtained in Examples within the claimed scope according to the present invention ensure 10 to 18 or more cutting cycles until the edges fracture finally in cutting test 2, whereas the reference tips stand up to only 5 or less cutting cycles.

The wear of the clearance face of the inventive tips subjected to 10-minute cutting substantially ranges from 0.149 to 0.185, whereas that of the reference tips is no less than 0.215. The sample No. 17 exhibits a prominently large number of cutting cycles, i.e., a very high strength although the wear resistance in the cutting test 1 is slightly lower than the sample Nos. 1–10. However, such a tip is very useful because different types of work pieces and different cutting conditions are usually employed in the practical cutting in the art.

Thus, the inventive tips are by far superior to the conventional tips in various cutting properties.

What is claimed is:

1. A titanium nitride base cermet with high toughness consisting essentially of, by weight, 42 to 95% of TiN, 2 to 20% of one or more of Mo, W and the carbides thereof, 2.85 to 30% of Ni, Co or a mixture thereof, and 0.15 to 8.0% of $Al_4C_3$, with the balance being inevitable impurities.

2. A cermet as defined in claim 1, wherein TiN is 42 to 91% by weight.

3. A cermet as defined in claim 2, wherein TiN is 42 to 70% by weight.

4. A titanium nitride base cermet with high toughness consisting essentially of, by weight, 35 to 95% of TiN, 2 to 20% of one or more of Mo, W and the carbides thereof, 2.85 to 30% of Ni, Co or a mixture thereof, and 0.15 to 8.0% of $Al_4C_3$, with the balance being inevitable impurities, wherein half or less, by weight, of TiN is replaced with one or more of the carbides and/or carbonitrides of metals selected from the group consisting of Ti, Zr, Hf, V, Nb and Ta, with the proviso that the remaining amount of TiN is no less than 30% in the cermet.

5. A cermet as defined in claim 1 or 4, wherein the impurities encompass, by weight less than 1.0% $O_2$, less 1.5% Fe, less than 0.5% Cr and traces of Na, Ca, Si, S, Cu, Mg, P and B.

6. A cermet as defined in claim 4, wherein the carbide and/or carbonitride of the metals is one or more selected from the group consisting of TiC, ZrC, HfC, VC, NbC, TaC and TiCN.

7. A cermet as defined in claim 1 or 4, wherein $Al_4C_3$ is 0.5 to 7% by weight.

8. A cermet as defined in claim 7, wherein $Al_4C_3$ is 0.5 to 1.5% by weight.

9. A cermet as defined in claim 1 or 2, wherein W, Mo and/or carbides thereof amount to 4.7 to 17% by weight.

10. A cermet as defined in claim 1 or 4, wherein Ni and/or Co amount to 4 to 23% by weight.

11. A cermet as defined in claim 10, wherein Ni and/or Co amount to 4 to 18% by weight.

12. A cermet as defined in claim 1 or 4, wherein the Rockwell hardness HRA is 88.0 or more.

13. A cermet as defined in claim 12, wherein the Rockwell hardness HRA is 91.3 or more.

14. A cermet as defined in claim 4, wherein the remaining TiN after substitution amounts to 35 to 91% by weight.

15. A cermet as defined in claim 14, wherein the remaining TiN after substitution amounts to 35 to 70% by weight.

* * * * *